United States Patent [19]

Miyagi et al.

[11] 4,392,467

[45] Jul. 12, 1983

[54] METHOD FOR OPERATING FUEL INJECTOR IN A COMPUTER CONTROLLED FUEL INJECTION TYPE INTERNAL COMBUSTION ENGINE

[75] Inventors: Hideo Miyagi, Okazaki; Toshio Suematsu, Toyota; Jiro Nakano, Okazaki; Hironobu Ono, Toyota, all of Japan

[73] Assignee: Toyota Jidosha Kogyo Kabushiki Kaisha, Toyota, Japan

[21] Appl. No.: 285,313

[22] Filed: Jul. 22, 1981

[30] Foreign Application Priority Data

Sep. 16, 1980 [JP] Japan ..... 55-127090

[51] Int. Cl.[3] ..... F02D 5/00

[52] U.S. Cl. ..... 123/325; 123/339; 123/480; 123/493

[58] Field of Search ..... 123/325, 339, 493, 480; 364/431.04, 431.05

[56] References Cited

U.S. PATENT DOCUMENTS

| | | | |
|---|---|---|---|
| 3,570,460 | 3/1971 | Rabus | 123/325 |
| 4,305,365 | 12/1981 | Iizuka et al. | 123/325 |
| 4,306,527 | 12/1981 | Kinugawa et al. | 123/339 |

*Primary Examiner*—Craig R. Feinberg
*Assistant Examiner*—Andrew M. Dolinar
*Attorney, Agent, or Firm*—Parkhurst & Oliff

[57] ABSTRACT

An internal combustion engine provided with a system for controlling the predetermined idling rotational speed $N_F$ of the engine, and a system for operating a fuel injector so that the injector is de-energized when the rotational speed is higher than $N_{cut}$ and the injector is energized when the rotational speed is lower than $N_{RTN}$. A value of $N_{cut}$ is the product of $N_F$ and a predetermined positive value $\alpha_1$ and the value of $N_{RTN}$ is the product of $N_F$ and a predetermined positive value $\alpha_2$ ($<\alpha_1$).

2 Claims, 6 Drawing Figures

INPUT OF TEMPERATURE OF THE ENGINE
80
CALCULATION OF NF
82
N cut ← α1 x NF
84
N RTN ← α2 x N
86
IS THE IDLE SWITCH ON CONDITION ?
88
NO
YES

METHOD FOR OPERATING FUEL INJECTOR IN A COMPUTER CONTROLLED FUEL INJECTION TYPE INTERNAL COMBUSTION ENGINE

FIELD OF THE INVENTION

The present invention relates to an electronic fuel injection control type internal combustion engine provided with a so-called fast idling control system and with a fuel cut system during the deceleration condition of the engine.

BACKGROUND OF THE INVENTION

In a so-called fast idle system, the amount of intake air introduced into the engine during the idling condition of the engine is controlled in accordance with the temperature of the engine, so that excess air is introduced into the engine when it is cold. As a result of the supply of excess air, the idling speed of the engine at low temperature is maintained to a high speed value $N_F$. When the engine is under deceleration the throttle valve is also under idling position. During deceleration condition, the supply of fuel is stopped in order to prevent the over heating of the exhaust system by detecting a predetermined rotational speed value $N_{cut}$. If the rotational speed of the engine is dropped to a predetermined value $N_{RTN}$ lower than the first predetermined value $N_{cut}$ the fuel is supplied.

When the fast idling operation is carried out, the idling rotational speed is high and can exceed the predetermined value $N_{cut}$. At this situation the fuel supply is stopped during the idling condition, causing an unstable idling operation to take place. In order to prevent this situation from occurring, in a conventional technic, values of $N_{cut}$ are, in accordance with the temperature of the engine, stored in the memory, each of the value $N_{cut}$ is higher than the values of $N_F$ at any temperature of the engine. In this case, the value of $N_{cut}$ is always larger than the value of $N_F$, so that unstable idling is prevented. However, this conventional system suffers from a drawback in that the computer must have a large number of memory cells.

SUMMARY OF THE INVENTION

An object of the present invention is to provide a method for operating a fuel injector during a deceleration condition, capable of controlling the values of the rotational speed when the fuel injector is stopped without increasing the number of memory cells.

According to the present invention a method is provided for controlling the operation of a fuel injector in a computer controlled fuel injection internal combustion engine, which engine is provided with a system for maintaining a predetermined idling rotational speed $N_F$ in accordance with the temperature of the engine and with a system for controlling the operation of the fuel injector during the deceleration condition of the engine so that the injector is de-energized when the rotational speed is higher than $N_{cut}$ and injector is energized when the rotational speed is lower than $N_{RTN}$, said method comprising the steps of:

storing in the computer values of $N_F$ in accordance with the temperature of the engine;

detecting the temperature of the engine;

reading out the value of $N_F$ corresponding to the detected temperature;

calculating, as the value of $N_{cut}$, the product of a constant positive value $\alpha_1$ larger than 1.0 and the read out value of $N_F$, and;

calculating, as the value of $N_{RTN}$, a product of constant positive value $\alpha_2$ larger than 1.0 ($<\alpha_1$) and the read out value of $N_F$.

BRIEF DESCRIPTION OF ATTACHED DRAWINGS

FIG. 1 shows a computer control engine according to the present invention.

FIGS. 2*a* and 2*b* show a diagrammatic view of a computer in FIG. 1.

FIG. 3 shows a graph showing the relationship between the temperature of the engine and the values of rotational speed.

FIGS. 4*a* and 4*b* show a flow diagram effected in the computer of FIGS. 2*a* and 2*b*.

DETAILED DESCRIPTION OF A PREFERRED EMBODIMENT

Figure 1:
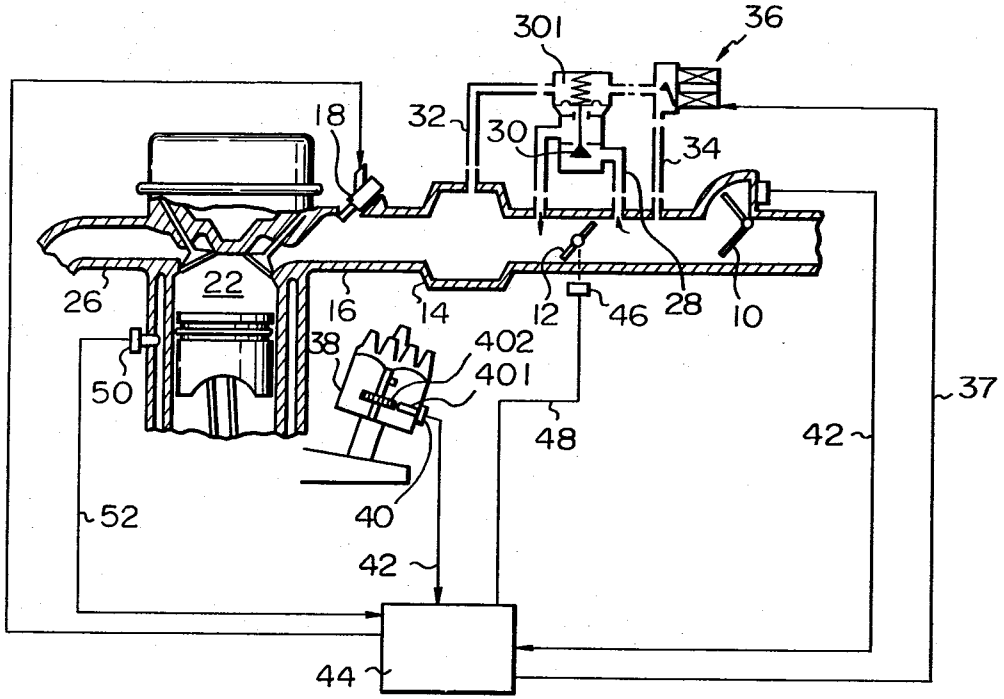

Now, the present invention will be described with reference to the attached drawings. In FIG. 1, which schematically illustrates an internal combustion engine of an electrical fuel injection type, intake air, the amount of which is measured by an air flow meter 10, enters via a throttle valve 12 into a surge tank 14. The air in the surge tank 14 enters via an intake manifold 16 into respective combustion chambers 22 together with fuel from respective fuel injection valves 18. The resultant combustible mixture is, at a predetermined crank angle determined by a distributor 38, ignited by a not shown electrode. An exhaust gas is received by an exhaust manifold 26.

The engine is further provided with a device for controlling the amount of the intake air during the idling condition of the engine.

The device includes a by-pass passageway 28 adapted for connecting the upstream side of the throttle valve 12 with the downstream side of the throttle valve 12. A flow control valve 30 is mounted on the by-pass passageway 28 in order to control the amount of air passing through the passageway. The flow control valve 30 is provided with a vaccum operating chamber 301 which is connected to the surge tank 14 via a vacuum signal pipe 32. The vacuum operating chamber 301 is via a pipe 34 also connected to the intake pipe of the engine at a position upstream of the throttle valve 12. An electro-magnetic valve 36 is mounted on the pipe 34. When the electro-magnetic valve 36 is opened the chamber 301 is under a pressure close to atmospheric air pressure, so that the degree of opening of the flow control valve 30 is large for obtaining a large amount of the by-pass air passing through the passageway 28. When the electro-magnetic valve 36 is closed, the chamber 301 is under a vacuum pressure, so that the degree of opening of the flow control valve is small to obtain a small amount of the air passing through the by-pass passageway 28.

The air flow sensor 10 provides an electrical signal indicating the amount of intake air introduced into the combustion chamber 22, which signal is via an electrical line 37 introduced into an electric control circuit 44. A crank angle sensor 40 is comprised of a detector member 401 and a gear member 402 fixed to a distributing shaft of the distributor 38. A pulsative signal having a number of pulses during one rotation of the shaft, i.e., on rotation of the engine, is issued from the sensor 40, which is via an electrical line 42 introduced into the electrical control circuit 44. A throttle position sensor 46 cooperating with the throttle valve 12 serves to provide an electrical signal indicating a fully closed position of the throttle valve 12 which is via an electrical line 48 into the control circuit 44. An engine temperature sensor 50 is mounted on the engine body so that it is in touch with engine cooling water in a water jacket in the engine body. The signal from the temperature sensor 50 is via an electrical line 52 introduced into the control circuit 44.

Figure 2A:
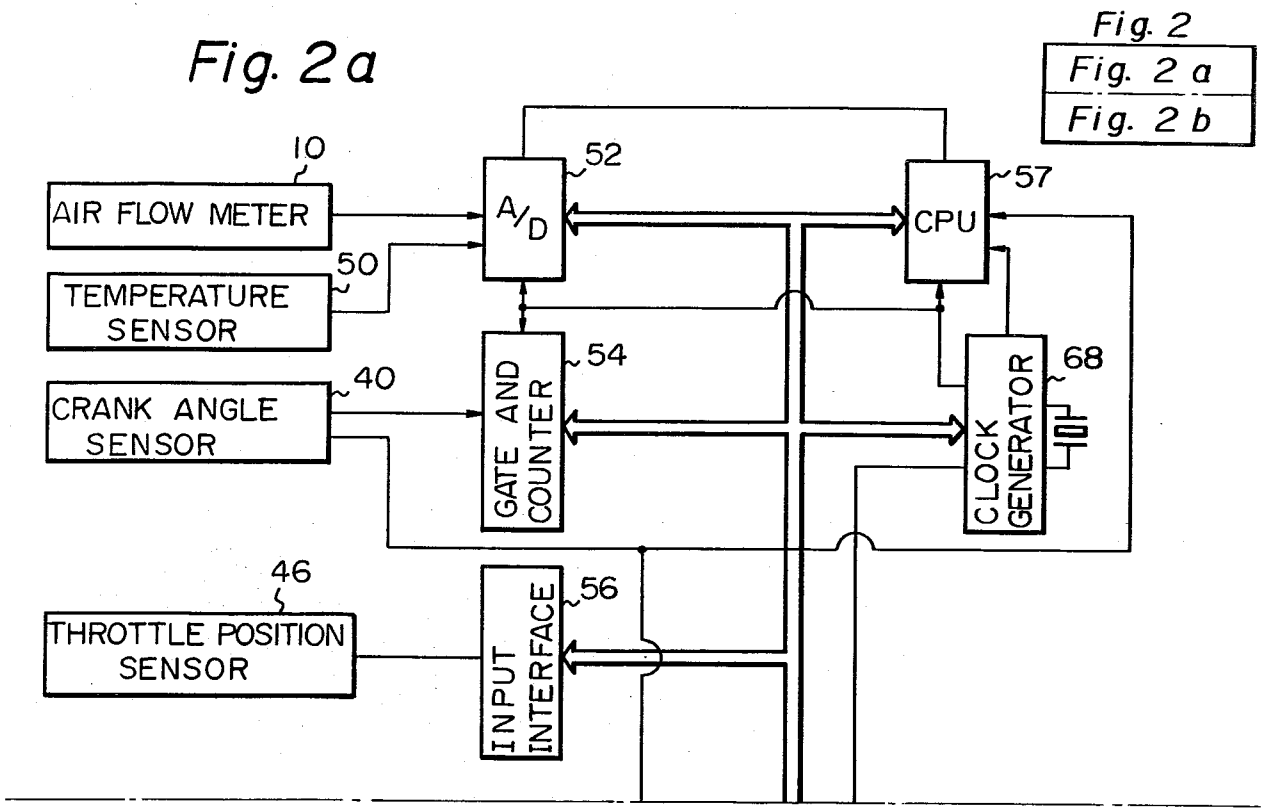
Figure 2B:
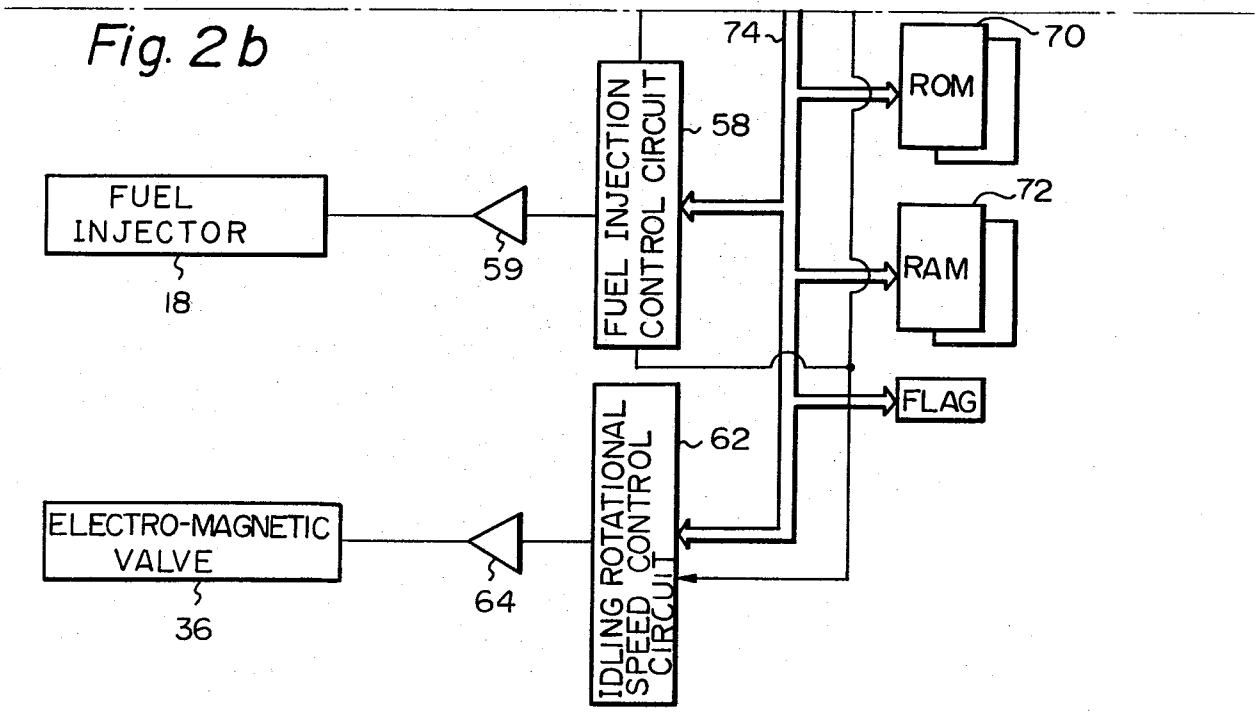

A diagrammatic construction of the electrical control unit 37 is shown in FIG. 2. An analogue signal from the sensor 10, indicating the amount of intake air passing through the intake line of the engine and an analogue signal from the temperature sensor 50, indicating the temperature of the coolant in the engine are introduced into an analogue to digital converter 50 and are transformed into digital signals. A digital signal from the crank angle sensor 40 is received by a gate and counter unit 54 in order to obtain a signal corresponding to the rotational speed N of the engine.

A signal from the throttle position sensor 46 is received by an input interface 56 so that a value indicating the position of the throttle valve 12 is stored in a resistor in the interface 56.

The control circuit 37 further includes a fuel injection control unit 58 comprising a gate and counter unit adapted for providing, at a predetermined crank angle, a signal which corresponds to the amount of fuel to be injected and which is via a power amplifier unit 59 introduced into the fuel injection valve 18.

An idling speed control unit 62 is also comprised by a gate and a counter unit for providing a signal which is via an electrical power amplifier 64 introduced into the electro-magnetic valve 36 for controlling the opening of the flow control valve 32 corresponding to the idling rotational speed of the engine.

The A/D converter 52, the engine rotational speed forming unit 54, the interface 56, the fuel injection control circuit 58 and the idling rotational speed control unit 62 are via a bus 74 connected to components for constructing a micro-computer system including a CPU 57 (central processing unit), a clock generator 68, a ROM 70 (read only memory) and a RAM 72 (random access memory), so that the transmission of input and output datas are effected between these components.

The idling rotational speed is controlled to a value $N_F$. This control is of course effected under a predetermined program instructed by the control unit 44. However, such program is itself well known. Therefore the control of the idling rotational speed is very briefly described hereinbelow.

Figure 3:
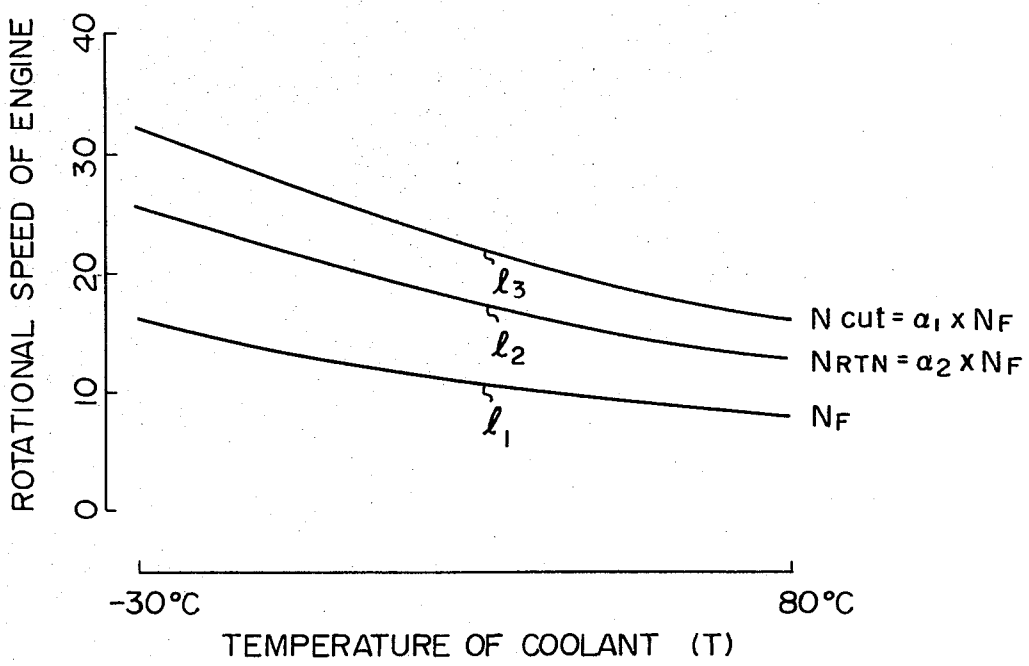

The sensor 46 detects the idling position of the throttle valve 12 while the sensor 40 detects the idling rotational speed. The sensor detects the temperature of the cooling water in the engine. In the ROM 70, values of the predetermined idling rotational speed N are, in accordance with values of the temperature of the cooling water of the engine, memorized, as shown by curve $l_1$ in FIG. 3. A value of idling rotational speed $N_F$ corresponding to a sensed value of temperature T is calculated. The calculated value is compared with the sensed idling rotational speed of the engine. If the actual rotational speed is lower than the predetermined idling rotational speed at the sensed temperature, the idling rotational speed control circuit 58 operates the electromagnetic valve 36. As a result of this the opening of the flow control valve 30 is increased so that the amount of air passing through the by-pass passage 28 is also increased. Therefore, the rotational speed of the engine is directed to the predetermined rotational speed. If the actual rotational speed N is higher than the predetermined value $N_F$ idling rotational control circuit 58 deenergizes the electro-magnetic valve 36. As a result of this an opening of the flow control valve 30 is decreased so that the amount of intake air is also decreased. Therefore, the rotational speed of the engine is decreased to the predetermined value $N_F$.

In a conventional electrical control fuel injection system the control of fuel injection during the deceleration condition of the engine is effected as is described hereinbelow. When the rotational speed N of the engine is higher than the value $N_{cut}$, the operation of the fuel injector 18 is stopped. As a result of this stopping, the rotational speed N of the engine is decreased. When the rotational speed of the engine becomes lower than the value $N_{RTN}$ the operation of the fuel injector valve is restarted.

The values $N_{cut}$ and $N_{RTN}$ should be sufficiently higher than the predetermined idling rotational speed value $N_F$ for maintaining a stable idling operation of the engine. The value $N_F$ should be changed in accordance with the temperature of the engine. Therefore, the values $N_{cut}$ and $N_{RTN}$ which are higher than the value $N_F$ should be properly changed in accordance with the temperature of the engine. One solution easily thought of by those skilled in this art is such that values of $N_{cut}$ and $N_{RTN}$ are memorized, in a memory unit, in accordance with the temperature of the engine. However, this requires a large amount of extra memory cells which results in an increase in the cost of the system.

According to the present invention, in order to overcome this drawback, the following described method is proposed in order to control the operation of the fuel injector during the deceleration condition of the engine. Now, the method is described with reference to the flow diagram shown in FIG. 4.

At point 80, the CPU 57 reads out a value temperature of the coolant in the engine which is received by the A/D converter and is stored in the RAM 72.

Figures 4, 4A, 4B:
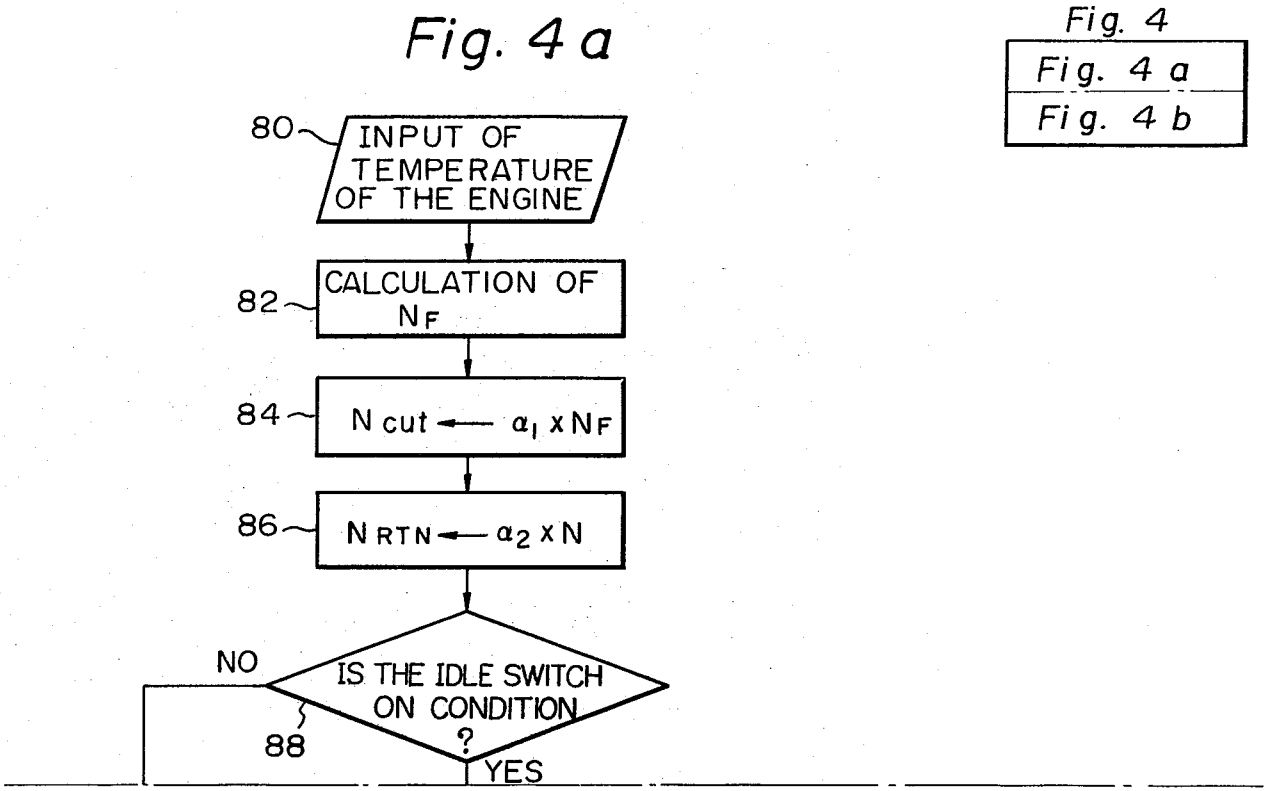
Figure 4B:
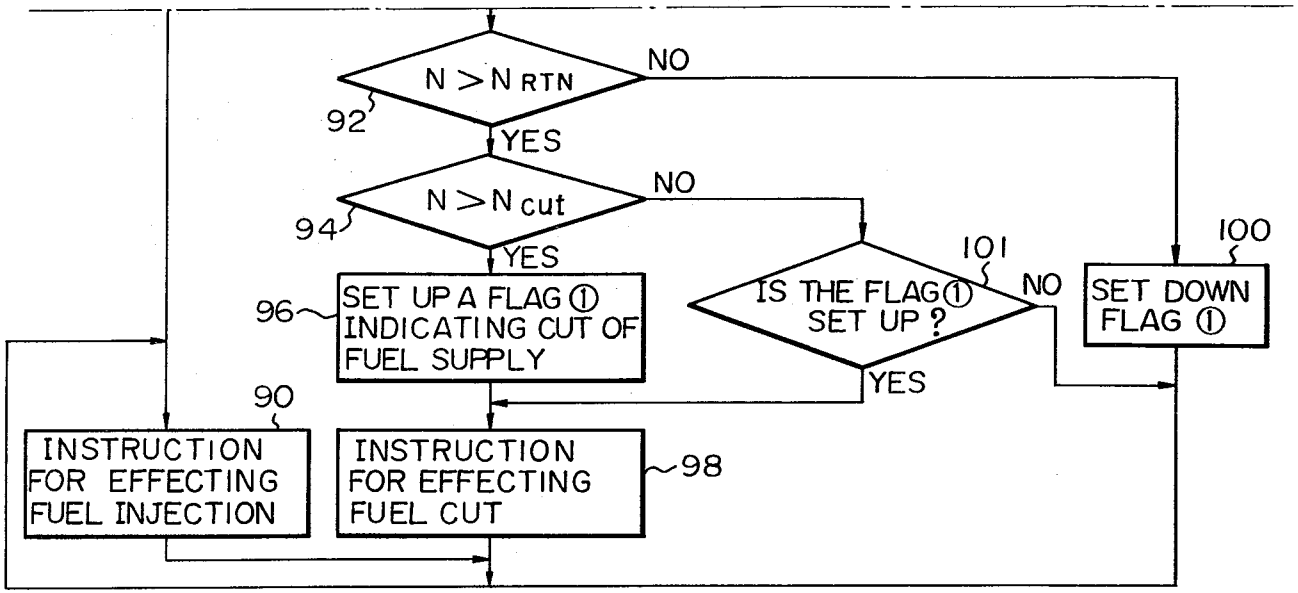

At point 82, the CPU 57 calculates from FIG. 4 a value of the predetermined idling rotational speed $N_F$ corresponding to the value of the temperature detected at the point 80.

At point 84, a predetermined positive number (for example 2.0) $\alpha_1$ is multiplied by the value of $N_F$ as a value of the predetermined engine rotational speed $N_{cut}$ where the operation of the fuel injector should be stopped.

At point 86, a predetermined positive number $\alpha_2$ lower than $\alpha_1$ (for example 1.6) is multiplied by the value of $N_F$ which is the value of the predetermined engine rotational speed $N_{RTN}$ where the operation of the fuel injector check is restarted. The calculated values of $N_{cut}$ and $N_{RTN}$ are stored in memory cells of the RAM 72. As will be clear from above, the values of $N_{cut}$ and $N_{RTN}$, in accordance with the temperature of the engine coolant water, are calculated only by multiplying the number $\alpha$ and $\beta$ by $N_F$, as shown by the curves $l_2$ and $l_3$ in FIG. 3.

At point 88, it is discriminated whether the throttle valve 12 is in its idle or fully closed position. If the result of the discrimination at point 90 is YES, the program proceeds to step 90, where the operation of the fuel injector 18 is allowed. If the result of the discrimination at step 88 is YES, the program proceeds to step 92.

At point 92, discrimination is effected whether or not the actual rotational speed of the engine N sensed by the sensor is higher than the value $N_{RTN}$. If the result of the discrimination at point 92 is YES the program proceeds to point 94.

At point 94 discrimination is effected whether or not the actual rotational speed N of the engine is higher than the predetermined value $N_{cut}$. If the result of discrimination at point 94 is YES, the program proceed to point 96. At point 96 a flag resistor is set up, which indicates that the fuel injector 18 is in the stopped condition.

At point 98, the program enters into a fuel cut routine in order to stop the operation of the fuel injector.

If the result of discrimination at point 92 is NO, this indicates that fuel injection is necessary. Therefore, the program proceeds to point 100, where the flag resistor is cleared, and then proceeds to the above-mentioned point 90 in order to allow the fuel injector to operate.

If the result of discrimination at point 94 is YES, the program proceeds to point 101. At point 101 discrimination is effected whether or not the flag resistor is set up or not. A result of YES indicates that the rotational speed is decreasing, and therefore the program proceeds to step 98 in order to stop the operation of fuel injector.

If the result of the discrimination at point 101 is NO, this indicates that the rotational speed of the engine is increasing. Thus, the program proceeds to step 90 in order to effect fuel injection.

As will be clear from above the present invention make it possible to determine the values of $N_{cut}$ and $N_F$ by merely multiplying constant number $\alpha_1$ and $\alpha_2$ to the monorized values of $N_F$. This result in an effect for saving volume of memory cells.

We claim:

1. Method for controlling the operation of a fuel injector in a computer controlled fuel injection internal combustion engine, which engine is provided with a system for maintaining a predetermined idling rotational speed $N_F$ in accordance with the temperature of the engine and with a system for controlling the operation of the fuel injector during the deceleration condition of the engine so that the injector is de-energized when the rotational speed is higher than $N_{cut}$ and injector is energized when the rotational speed is lower than $N_{RTN}$, said method comprising the steps of:

storing in the computer values of $N_F$ in accordance with the temperature of the engine;

detecting the temperature of the engine;

reading out the value of $N_F$ corresponding to the detected temperature;

calculating, as the value of $N_{cut}$, the product of a constant positive value $\alpha_1$ larger than 1.0 and the read out value of $N_F$, and;

calculating, as the value of $N_{RTN}$, a product of constant positive value $\alpha_2$ larger than 1.0 but less than $\alpha_1$ and the read out value of $N_F$.

2. Method according to claim 1, wherein said value of $\alpha_1$ is 2.0, and said value of $\alpha_2$ is 1.6.

* * * * *